US007081853B2

(12) United States Patent
Amano et al.

(10) Patent No.: US 7,081,853 B2
(45) Date of Patent: Jul. 25, 2006

(54) MOBILE COMMUNICATION TERMINAL

(75) Inventors: Takashi Amano, Soka (JP); Hiromichi Suzuki, Hino (JP); Norimichi Chiba, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/386,421

(22) Filed: Mar. 13, 2003

(65) Prior Publication Data

US 2004/0046699 A1 Mar. 11, 2004

(30) Foreign Application Priority Data

Sep. 10, 2002 (JP) ..... 2002-264255

(51) Int. Cl.
*H01Q 1/24* (2006.01)

(52) U.S. Cl. ..... 343/702; 343/729

(58) Field of Classification Search ..... 343/702, 343/900, 901

See application file for complete search history.

(56) References Cited

U.S. PATENT DOCUMENTS

| | | | | |
|---|---|---|---|---|
| 6,133,881 | A * | 10/2000 | Kushihi et al. | 343/700 MS |
| 6,380,903 | B1 * | 4/2002 | Hayes et al. | 343/725 |
| 6,388,626 | B1 * | 5/2002 | Gamalielsson et al. | 343/702 |
| 6,452,558 | B1 * | 9/2002 | Saitou et al. | 343/725 |

FOREIGN PATENT DOCUMENTS

| | | | |
|---|---|---|---|
| EP | 0707354 | A1 | 4/1996 |
| EP | 0924795 | A1 | 6/1999 |
| EP | 1199769 | A1 | 4/2002 |
| JP | 56-714 | | 1/1981 |
| JP | 2-271701 | | 11/1990 |
| JP | 4-58603 | | 2/1992 |
| JP | 5-327527 | | 12/1993 |
| JP | 7-154084 | | 6/1995 |
| JP | 8-97760 | | 4/1996 |
| JP | 2000-40913 | | 2/2000 |
| JP | 2001-36317 | | 2/2001 |
| JP | 2001-160706 | | 6/2001 |
| JP | 2001-308620 | | 11/2001 |
| JP | 2001-358517 | | 12/2001 |
| JP | 2002-64324 | | 2/2002 |
| JP | 2002-232224 | | 8/2002 |

OTHER PUBLICATIONS

A. K. Bhattacharyya, "Microstrip Patch Designs Which Do Not Excite Surface Waves," Dept. of Electrical Engineering, Univ. of Saskatchewan.

(Continued)

*Primary Examiner*—James Vannucci
(74) *Attorney, Agent, or Firm*—Finnegan, Henderson, Farabow, Garrett & Dunner, L.L.P.

(57) ABSTRACT

A mobile communication terminal comprises a first antenna element and a second antenna element. The first antenna element is arranged over the surface of the circuit substrate contained in the terminal cabinet, the surface being located remotest from the ear of the speaker on the phone. The second antenna element is arranged over the remotest surface and adapted to be pulled in the inside of the terminal cabinet or extended from the terminal cabinet, the second antenna element being electromagnetically coupled with one of the ends of the first antenna element in a state of being extended from the terminal cabinet.

6 Claims, 9 Drawing Sheets

OTHER PUBLICATIONS

Takashi Amano, et al., "Mobile Communication Terminal", U.S. Appl. No. 10/106,391, filed Mar. 27, 2002.

Takashi Amano, et al., "Antenna Structure and Mobile Terminal Having Antenna Structure", U.S. Appl. No. 10/028,792, filed Dec. 28, 2001.

Takashi Amano, et al., "Mobile Communication Station and Its Associated Antenna", U.S. Appl. No. 09/739,206, filed Dec. 19, 2000.

Japanese Office Action, dated Mar. 1, 2005, pp. 1-2; and English Translation, pp. 1-3.

Final Notice Of Rejection from Japanese Patent Office mailed Jun. 7, 2005, in Japanese Application No. 2002-264255.

European Patent Office Action dated Aug. 31, 2005, in European Patent Application No. 03005397.9-1248.

* cited by examiner

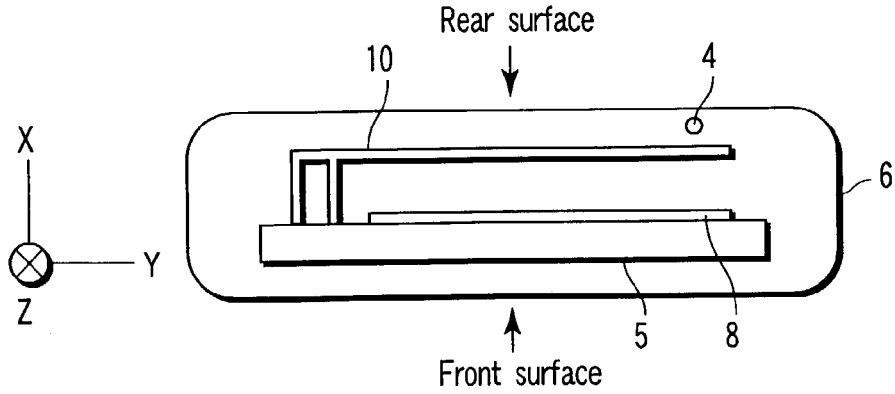
FIG. 12
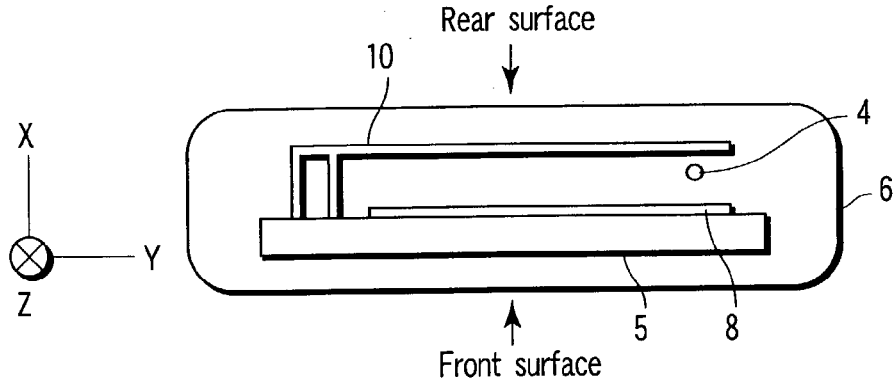
FIG. 13
FIG. 14A
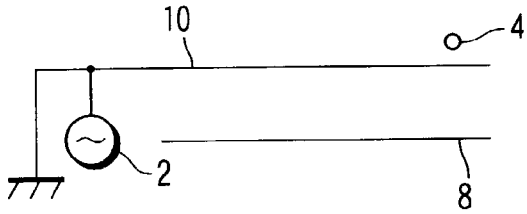
FIG. 14B
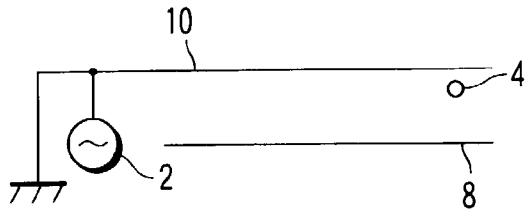

MOBILE COMMUNICATION TERMINAL

CROSS-REFERENCE TO RELATED APPLICATIONS

This application is based upon and claims the benefit of priority from the prior Japanese Patent Application No. 2002-264255, filed Sep. 10, 2002, the entire contents of which are incorporated herein by reference.

BACKGROUND OF THE INVENTION

1. Field of the Invention

The present invention relates to a mobile communication terminal such as a portable telephone, a portable information terminal (e.g., PDA: Personal Digital Assistants) or the like that is provided with a pair of antennas.

2. Description of the Related Art

Generally, a small mobile communication terminal such as a portable telephone or a portable information terminal is provided with a pair of antennas for the purpose of downsizing the terminal and maintaining a good reception sensitivity.

One of the antennas, or the first antenna, is typically a helical antenna that is rigidly secured to the top of the terminal cabinet. On the other hand, the other antenna, or the second antenna, is typically a rod antenna that is extendable and contained in the terminal cabinet.

In an idle state, the second antenna is pulled in the terminal cabinet and the incoming call signal is received by means of the first antenna. On the other hand, in a communication state, the second antenna is extended upward from the terminal cabinet and used.

With the above described arrangement, only the first antenna is projecting from the terminal cabinet in the idle state so that the terminal provides a good portability.

Meanwhile, in recent years, there have been developed various mobile communication terminals that are equipped with a mail communication feature, a video communication feature involving the use of a camera and so on in addition to the speech communication feature. Such a mobile communication terminal is used not only for speech communication where the terminal is put to one of the ears of the user but also for data communication where the user operates the terminal, watching the image on its screen.

Therefore, the antenna that is being in service for communication is required to be relatively free from the influence of the user's head and to improve the antenna gain for speech communication. On the other hand, the antenna that is being in service for communication is required to be non-directional for data communication and to maintain the antenna gain on a stable basis.

When the characteristics of mobile communication terminals marketed in recent years are examined from the viewpoint of fulfilling the above requirements, it will be seen that the antenna that is being used for data communication fulfills the requirement for that purpose but the performance of the antenna that is being used for speech communication can be degraded under the influence of the user's head.

Particularly, the radiation element of the helical antenna that becomes active when the rod antenna is pulled in can be shaded by the user's head to a large extent. Therefore, it is apt to be significantly influenced by the user's head and hence can hardly maintain the antenna gain to a desired degree.

Additionally, it is well known that the input impedance of the antenna fluctuates as viewed from the feeding point of the antenna to make it impossible to maintain desired frequency characteristics when the mobile communication terminal is held by hand or brought close to the ear. Therefore, the antennas need to be designed by taking these influences into consideration.

Particularly, in the case of next generation mobile communication systems such as IMT2000, the radio frequency band is broadened by several times to make it highly difficult to design antennas if compared with that of conventional systems. More specifically, when the transmission frequency and the reception frequency is separated from each other by about 10 percent in terms of band ratio, it is extremely difficult to design the antennas if the conventional combination of a rod antenna and a helical antenna is used. Because the input impedance of the antenna fluctuates due to the difference between the transmission frequency and the reception frequency. If the antennas are not designed properly, the reception sensitivity will become poor particularly in an idle state and the quality of communication will be remarkably degraded for speech communication and data communication.

Generally, in the case of mobile communication terminals such as a portable telephone, not only the antennas but also the terminal cabinet are active as radiator to radiate a radio wave from the terminal. Therefore, the size of the cabinet is an important design parameter for designing the antennas of the terminal. Additionally, as a result of the use of higher radio frequencies in recent years, the cabinet has become large relative to the wavelength and hence the unbalanced current of the antenna is induced into the cabinet in a complex manner. This situation provides a large factor that makes the design of the antennas even more difficult.

Various proposals have been made to suppress the unbalanced current that is induced into the cabinet in order to avoid the problem. According to a proposal, for example, the terminal cabinet is notched to suppress the unbalanced current induced into the bottom side of the cabinet (see, for example, Japanese Patent Application KOKAI Publication No. 5-327527). According to another proposal, the substrate is provided with a stub to suppress the current induced into the bottom side of the cabinet.

While these proposals are very effective, forming such a notch or stub may not be feasible for mobile communication terminals such as a portable telephone and so on that are compact and densely mounted with components.

BRIEF SUMMARY OF THE INVENTION

The present invention has been made in view of the foregoing. An object of the present invention is to provide a mobile communication terminal having antennas that perform well for speech communication and adapted to a broad frequency band and reduction of the unbalanced current of the antenna that is induced into the cabinet.

According to an aspect of the present invention, the above object is achieved by providing a mobile communication terminal comprising: a first antenna element connected to a circuit substrate contained in a terminal cabinet, and arranged inside the terminal cabinet; and a second antenna element arranged in one of a first state included in the terminal cabinet and a second state extended from the terminal cabinet, and adapted to be electromagnetically coupled with one of ends of the first antenna element in a state extended from the terminal cabinet.

Additional objects and advantages of the invention will be set forth in the description which follows and in part will be obvious from the description or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

FIG. 12 is a side view of mobile communication terminal shown in FIG. 11A and FIG. 11B as viewed in the negative Z-direction, showing the inside thereof;

FIG. 13 is a side view of the mobile communication terminal as viewed in the negative Z-direction, showing the inside thereof according to the modified fifth embodiment;

FIG. 14A is a circuit diagram corresponding to FIG. 12; and

FIG. 14B is a circuit diagram corresponding to FIG. 13.

DETAILED DESCRIPTION OF THE INVENTION

The embodiments of the present invention will be described, with reference to the accompanying drawings that illustrate the embodiments of the present invention.

First Embodiment

Figure 1A:
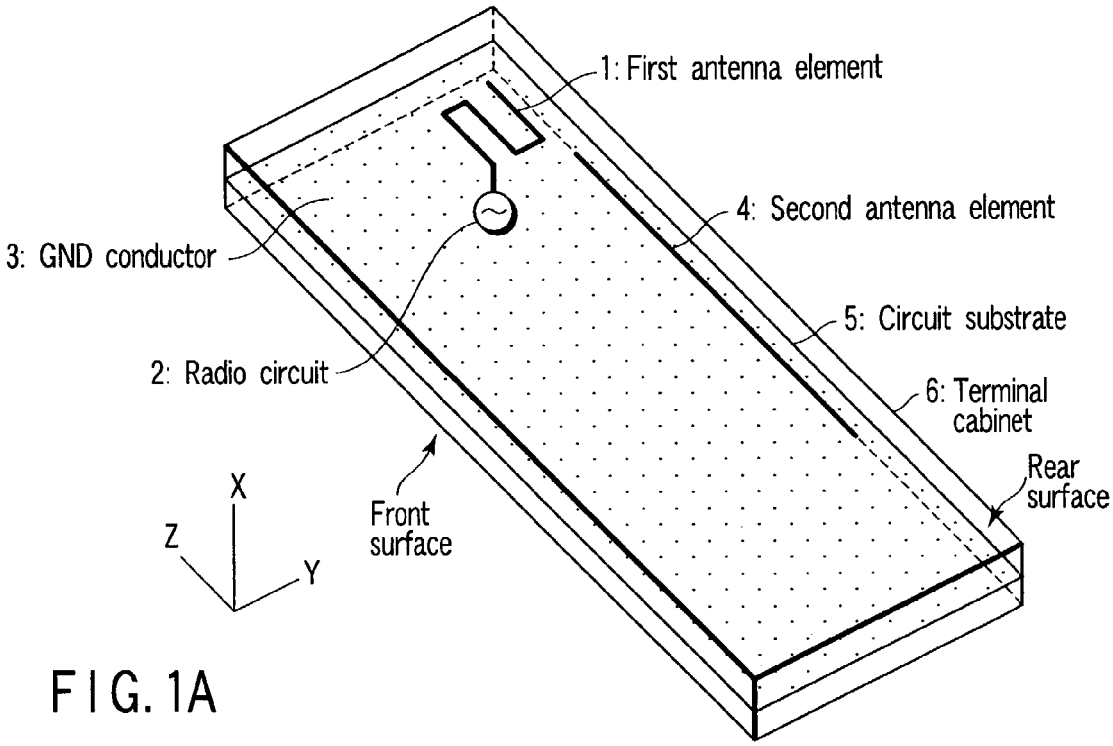
FIG. 1A is a perspective view of the mobile communication terminal with the second antenna element pulled in the cabinet according to the first embodiment.
Figure 1B:
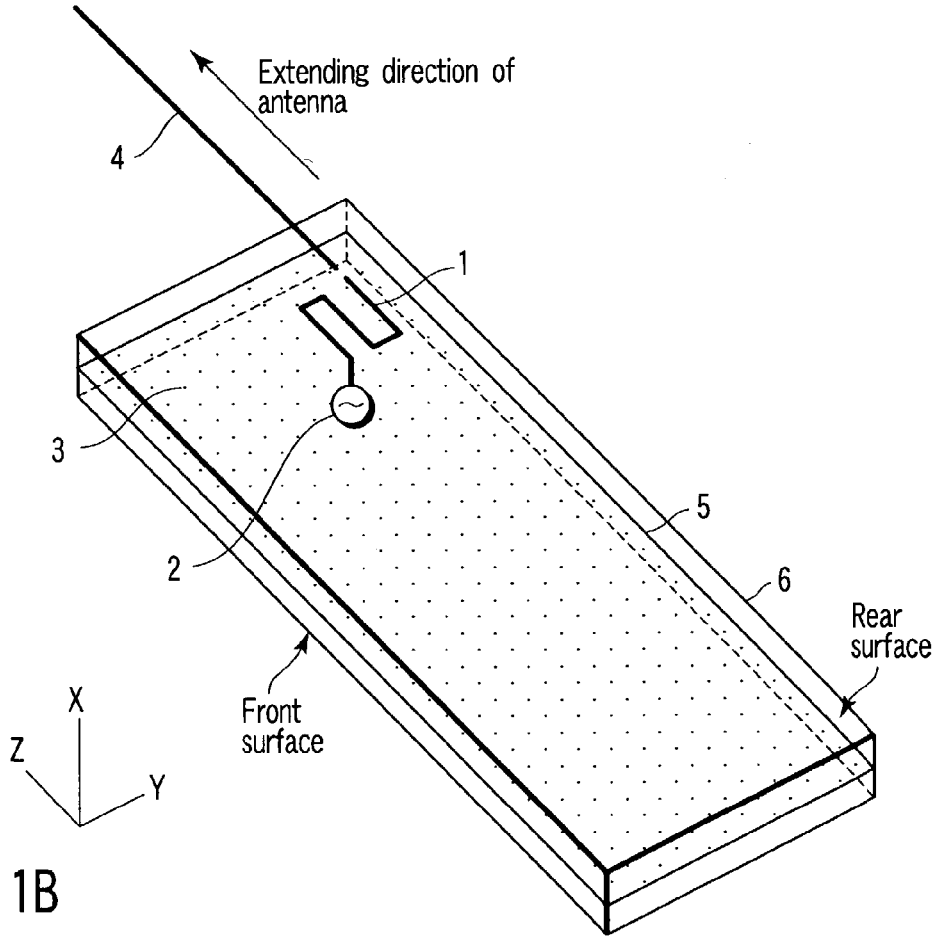
FIG. 1B is a perspective view of the mobile communication terminal with the second antenna element extended from the cabinet according to the first embodiment.

FIG. 1A is a perspective view of the mobile communication terminal with the second antenna element 4 pulled in the cabinet according to the first embodiment. FIG. 1B is a perspective view of the mobile communication terminal with the second antenna element 4 extended from the cabinet according to the first embodiment. Note that the mobile communication terminal of the embodiment is viewed from behind both in FIGS. 1A and 1B. In other words, in terms of the coordinate system shown in FIGS. 1A and 1B, the display section and the operation section of the embodiment are seen when the mobile communication terminal of the embodiment is viewed in the negative X direction.

A circuit substrate 5 is mounted in terminal cabinet 6. In general, a radio circuit 2 and a signal processing circuit (not shown) are mounted on the circuit substrate 5. Additionally, the first antenna element 1 that is made of a conductor having a length of about $\lambda/4$ is mounted on the circuit substrate 5, where $\lambda$ represents the wavelength of a typical radio wave that is to be transmitted from and received by the radio communication terminal. In the first embodiment, the first antenna element 1 is made to show a so-called meandering shape.

One of the ends of the first antenna element 1 is connected to the radio circuit 2 by way of a microstrip line that is arranged on the circuit substrate 5.

On the other hand, the second antenna element 4 that is also made of a conductor having a length of about $\lambda/2$ is mounted on the terminal in such a way that it can be extended to the outside of the terminal cabinet 5 and pulled in the inside of the terminal cabinet 5. The second antenna element 4 is a rod antenna that can be longitudinally extended from the terminal cabinet 6 and pulled in the terminal cabinet 6.

As shown in FIG. 1A, the first antenna element 1 and the second antenna element 4 are arranged in such a way that only the first antenna element 1 is active when the second antenna element 4 is pulled in. In other words, the second antenna element 4 is pulled in at a position where it is sufficiently separated from the first antenna element 1 and held electromagnetically independent from the first antenna element 1.

When the second antenna element 4 is pulled in, it does not appear to the outside of the terminal cabinet 6. In other words, unlike conventional mobile communication terminals such as a popular portable telephone, this mobile communication terminal of the first embodiment does not have any helical antenna that projects from the terminal.

As a result, when the user carries the mobile communication terminal of the first embodiment, the second antenna element 4 is pulled in the terminal cabinet 6 to make the cabinet very compact. Therefore, it can be put into a chest pocket or in a bag quite easily. In other words, the mobile communication terminal of the first embodiment is by far improved from comparable conventional terminals in terms of portability and storability.

On the other hand, the first antenna element 1 and the second antenna element 4 are arranged in such a way that one of the ends of the second antenna element 4 is electromagnetically connected to the corresponding end of the first antenna element 1 by electromagnetic coupling when the second antenna element 4 is extended as shown in FIG. 1B. In other words, when the second antenna element 4 is extended, the first antenna element 1 and the second antenna element 4 are functionally combined to activate as a single antenna. Thus, an antenna that shows characteristics good for a broad bandwidth can be realized by extending the second antenna element 4 to the outside of the terminal cabinet 6 when the mobile communication terminal is in service for communication.

Figure 2:
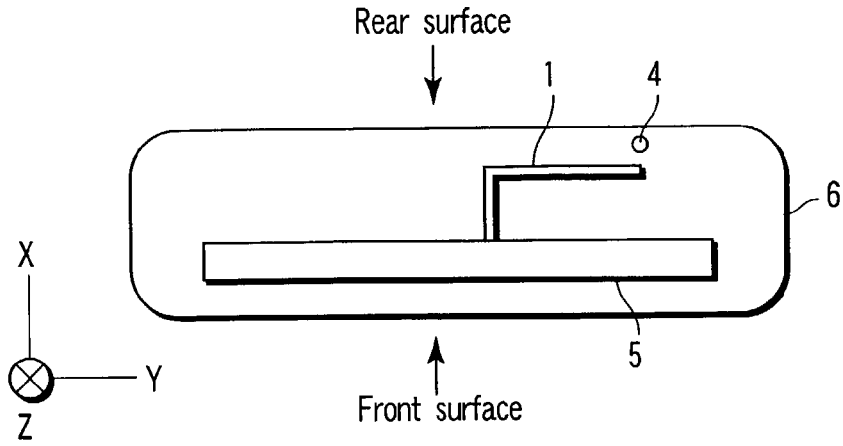
FIG. 2 is a side view of mobile communication terminal shown in FIG. 1A and FIG. 1B as viewed in the negative Z-direction, showing the inside thereof.

FIG. 2 is a side view of mobile communication terminal shown in FIG. 1A and FIG. 1B as viewed in the negative Z-direction, showing the inside thereof.

Referring to FIG. 2, the first antenna element 1 is arranged over the circuit substrate 5 and between the circuit substrate 5 and the rear surface of the terminal cabinet 6.

The second antenna element 4 is slightly separated from the first antenna element 1. The extent of electromagnetic coupling between the first antenna element 1 and the second antenna element 4 and the selectivity Q of the composite antenna formed by the first antenna element 1 and the second antenna element 4 are determined by the distance separating them. In the first embodiment, the value of the selectivity Q of the composite antenna can be reduced so that the composite antenna has good characteristics for a broad bandwidth.

The selectivity Q is an index that indicates the energy characteristic of the antenna relative to the frequency. If the selectivity Q is a large value, it means that the antenna has a steep energy characteristic to the frequency. In other words, an antenna having a large value for the selectivity Q shows characteristics good for a narrow bandwidth. On the other hand, if the selectivity Q is a small value, it means that the antenna has a gradual energy characteristic to the frequency. In other words, an antenna having a small value for the selectivity Q shows characteristic good for a broad bandwidth.

Feeding the second antenna element 4 by electromagnetic coupling is effective for a mobile communication terminal that requires a relationship of the transmission frequency and the reception frequency that is about 10 percent or more in terms of band ratio.

Figure 3:
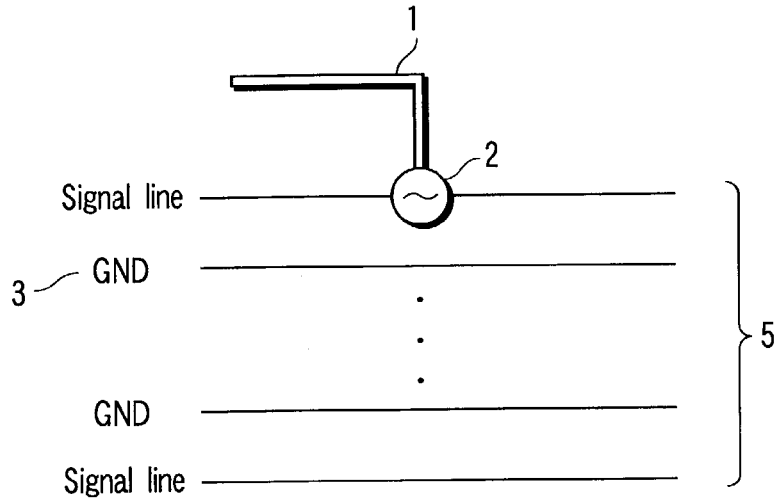
FIG. 3 is an illustration of connection of the circuit substrate of mobile communication terminal shown in FIG. 1A and FIG. 1B and the first antenna element.

FIG. 3 is an illustration of the connection of the circuit substrate 5 of mobile communication terminal shown in FIG. 1A and FIG. 1B and the first antenna element 1.

The circuit substrate 5 shows a multilayer structure generally having six to eight layers. A signal line is arranged in the top layer and a radio circuit 2 and other circuits are connected to the signal line. A grounding layer made of a conductor (GND conductor layer 3) is arranged under the top layer. The first antenna element 1 is mostly arranged in parallel with the grounding layer and located over the circuit substrate 5.

Figure 4A:
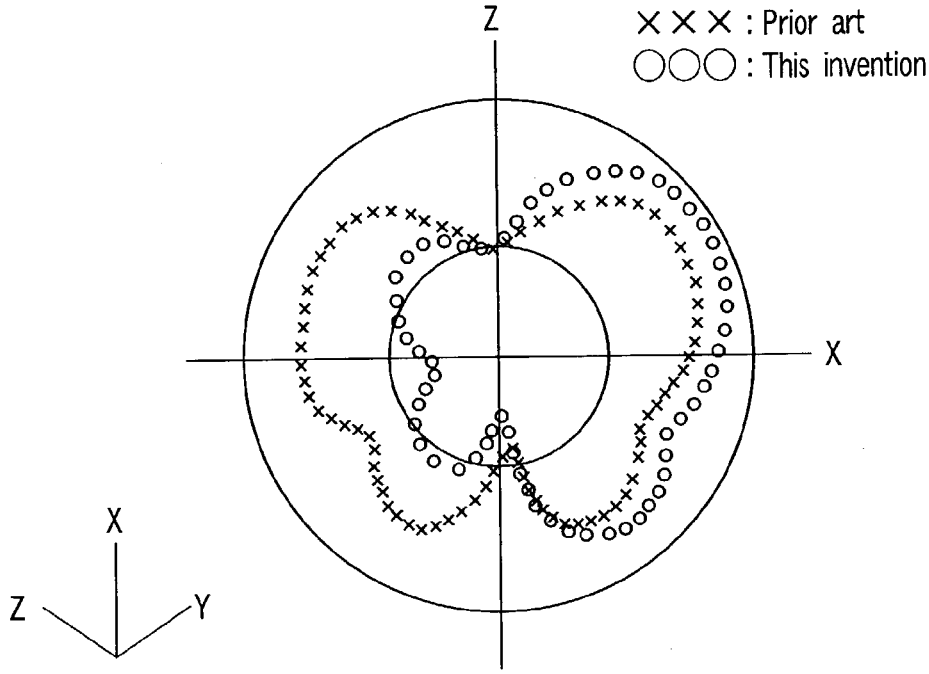
FIG. 4A is a graph showing the directivity of the antenna in a plane perpendicular to it when the antenna is in the state of FIG. 1A.
Figure 4B:
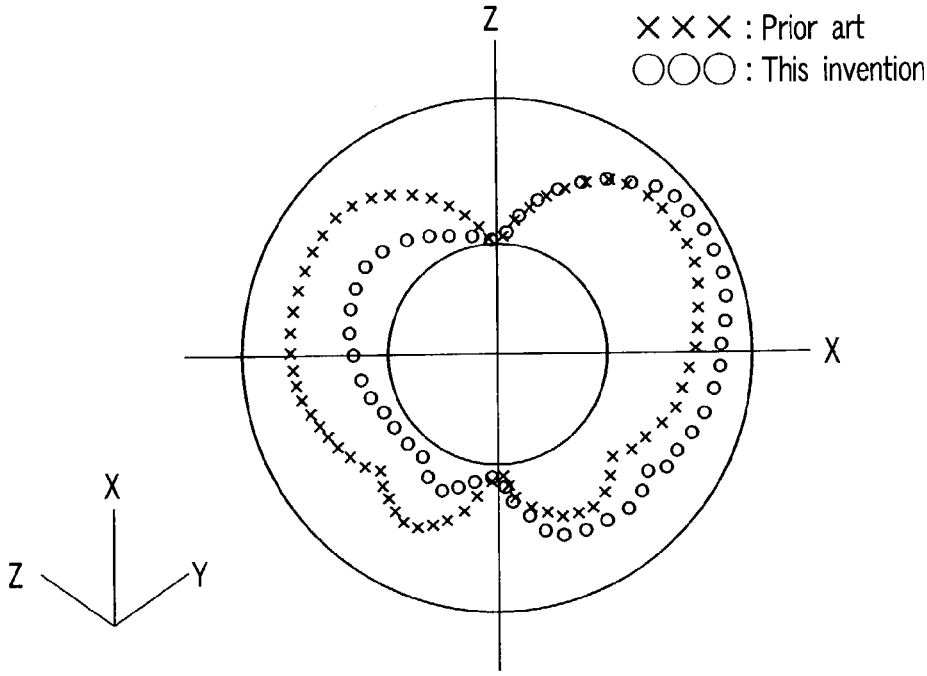
FIG. 4B is a graph showing the directivity of the antenna in a plane perpendicular to it when the antenna is in the state of FIG. 1B.

Now, the operations and the characteristics of the antennas will be described below. FIG. 4A is a graph showing the directivity of the antenna in a plane perpendicular to it when the antenna is in the state of FIG. 1A, and FIG. 4B is a graph showing the directivity of the antenna in a plane perpendicular to it when the antenna is in the state of FIG. 1B.

Only the first antenna element 1 is active when the second antenna element 4 is pulled in the terminal cabinet 6 as described above with reference to FIG. 1A.

The first antenna element 1 is arranged over the GND conductor layer 3 of the circuit substrate 5 as described above with reference to FIGS. 1A, 1B, 2 and 3. The first antenna element 1 has a length of $\lambda/4$ and the GND conductor layer 3 has a limited size. Therefore, the antenna configured in the above described manner shows a directivity that provides a large antenna gain in the direction of the rear surface if compared with the direction of the front surface of the mobile communication terminal as shown in FIG. 4A, because the GND conductor layer 3 reflects electromagnetic waves.

As a result, in a state where the second antenna element 4 is pulled in and the mobile communication terminal is in service for communication, the influence of the user's head on the mobile communication terminal of the first embodiment can be reduced if compared with conventional mobile terminals having a helical antenna. Therefore, it is possible for the mobile communication terminal of the first embodiment to improve the antenna gain when it is in service for communication.

When, on the other hand, the second antenna element 4 is extended from the terminal cabinet 6. The first antenna element 1 and the second antenna element 4 are electromagnetically coupled so that both the first antenna element 1 and the second antenna element 4 are activated as described above with reference to FIG. 1B.

Then, as described above, the first antenna element 1 operates as an antenna arranged over the GND conductor layer 3 and having a length of $\lambda/4$ and the second antenna element 4 can be regarded as an antenna having a length of $\lambda/2$ and being fed with power by way of one of its ends. Then, the directivity of the second antenna element 4 is same as that of a dipole antenna.

Therefore, when the second antenna element 4 is extended from the terminal cabinet 6, the directivity of the composite antenna formed by the first antenna element 1 and the second antenna element 4 can be obtained by synthesizing the directivity of an antenna arranged over the GND conductor layer 3 and having a length of $\lambda/4$ and the directivity of a dipole antenna.

As a result, the directivity of the antenna provides a large antenna gain in the direction of the rear surface if compared with the direction of the front surface of the mobile communication terminal as shown in FIG. 4B as in the case where the second antenna element 4 is pulled in the terminal cabinet 6.

Therefore, the mobile communication terminal of the first embodiment can provide an improved antenna gain when it is in service for communication if compared with conventional mobile communication terminals having a rod antenna.

As described above, with the mobile communication terminal of the first embodiment, it is possible to obtain an improved antenna gain when it is in service for communication regardless whether the antenna is pulled in or extended if compared with conventional mobile communication terminals having a rod antenna and a helical antenna. Additionally, the mobile communication terminal of the first embodiment can realize frequency characteristics good for a broad bandwidth including the antenna directivity. Still additionally, the portability is much more improved if compared with conventional mobile communication terminals.

Second Embodiment

Figure 6:
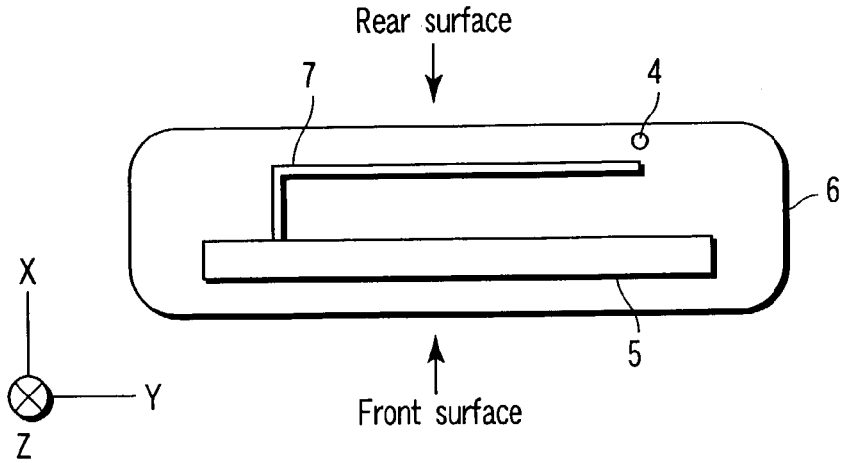
FIG. 6 is a side view of mobile communication terminal shown in FIG. 5A and FIG. 5B as viewed in the negative Z-direction, showing the inside thereof.
Figure 5A:
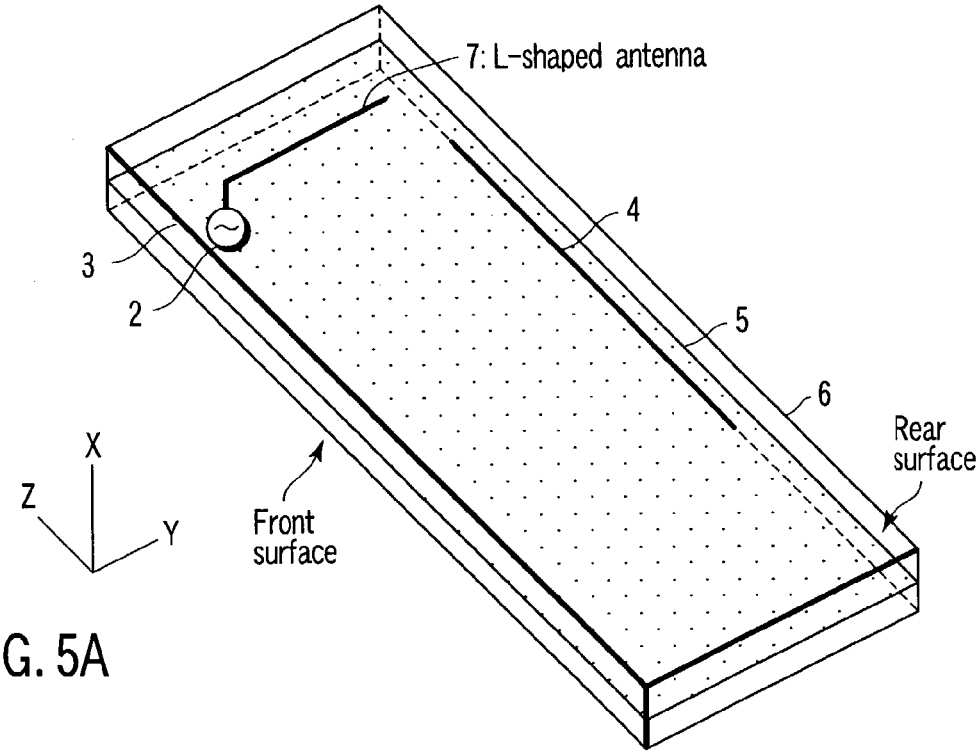
FIG. 5A is a perspective view of the mobile communication terminal with the second antenna element pulled in the cabinet according to the second embodiment.
Figure 5B:
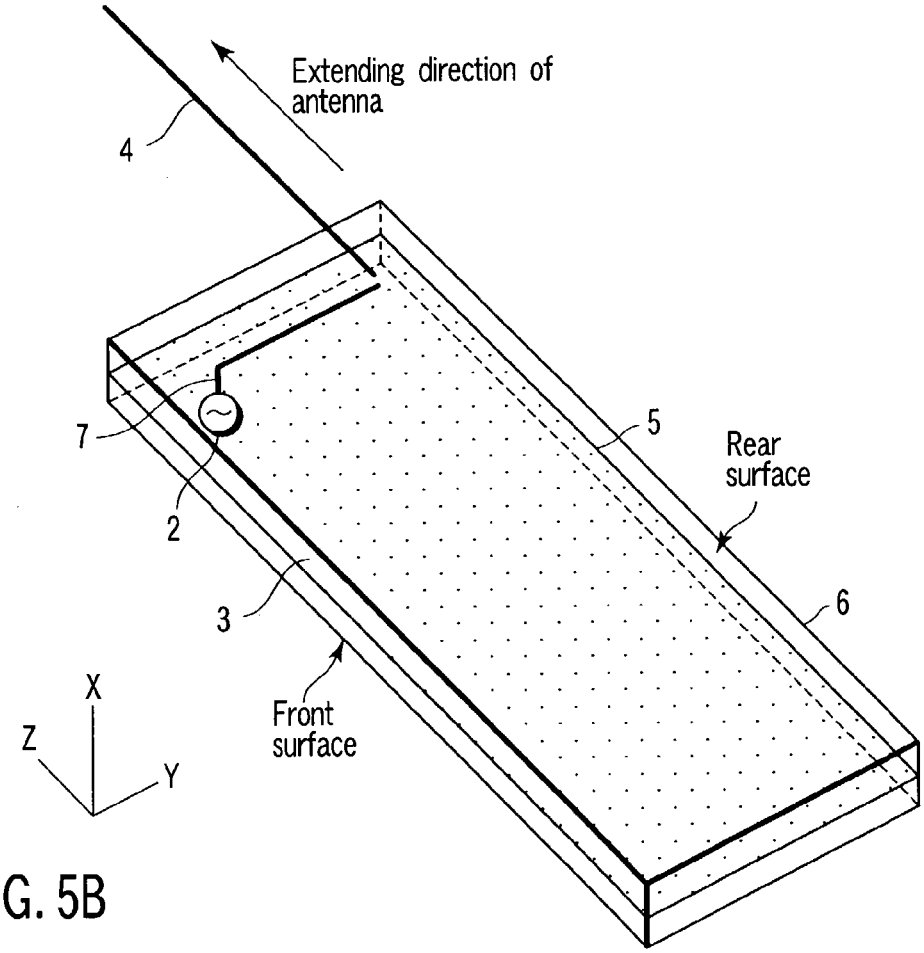
FIG. 5B is a perspective view of the mobile communication terminal with the second antenna element extended from the cabinet according to the second embodiment.

FIG. 5A is a perspective view of the mobile communication terminal with the second antenna element pulled in the cabinet according to the second embodiment. FIG. 5B is a perspective view of the mobile communication terminal with the second antenna element extended from the cabinet according to the second embodiment. FIG. 6 is a side view of mobile communication terminal shown in FIG. 5A and FIG. 5B as viewed in the negative Z-direction, showing the inside thereof.

The mobile communication terminal of this embodiment differs from the terminal of the first embodiment only in terms of the shape and the positional arrangement of the first antenna element. More specifically, while the first antenna element 1 of the first embodiment has a so-called meandering shape, the antenna element 7 of this embodiment is realized as so-called L-shaped antenna element that is a linear element extending along the Y-axis as shown in FIGS. 5A, 5B and 6.

Since the L-shaped antenna element 7 is arranged in parallel with the Y-axis in an upper part of the mobile communication terminal, the positional arrangement of the radio circuit 2 may be different from that of the first embodiment so that the radio circuit 2 may be connected to the L-shaped antenna element 7 without problem. Otherwise, the second embodiment is similar to the first embodiment. For example, the L-shaped antenna element 7 has a length of $\lambda/4$.

If compared with the first antenna element 1 of the first embodiment, the main radiation element of the L-shaped antenna element 7 of this embodiment is adapted to radiate the main polarized wave in the horizontal direction of the mobile communication terminal. Therefore, the mobile communication terminal of this embodiment indicates an antenna directivity that provides a large antenna gain in the horizontal direction of the mobile communication terminal if compared with the mobile communication terminal of the first embodiment.

The antenna directivity remains substantially unchanged when the second antenna element 4 is pulled in the terminal cabinet 6 and when it is extended from the terminal cabinet 6.

Generally, a mobile communication terminal is inclined by about 60° from the upright position when the user uses the terminal in service for speech communication because of the positional arrangement of the loudspeaker and the microphone of the terminal. Therefore, it is desirable that the vertically polarized component of a radio wave is radiated from the terminal in a state where the terminal is inclined by 60° in order to keep the terminal reliably connected to the antenna of the base station that mainly radiates a radio wave whose vertically polarized component perpendicular to the ground surface.

Since the mobile communication terminal of this embodiment indicates an antenna directivity that provides a large antenna gain in the horizontal direction of the mobile communication terminal if compared with the terminal of the first embodiment, it can be more reliably connected to the base station than the terminal of the first embodiment. In other words, the mobile communication terminal of this embodiment can provide an improved antenna gain when the user uses the terminal in service for speech communication if compared with the terminal of the first embodiment.

Otherwise, the mobile communication terminal of this embodiment provides advantages similar to those of the first embodiment.

As pointed out above, the mobile communication terminal of the above described second embodiment can provide an improved antenna gain if compared with the terminal of the first embodiment when it is in service for communication.

Third Embodiment

Figure 7A:
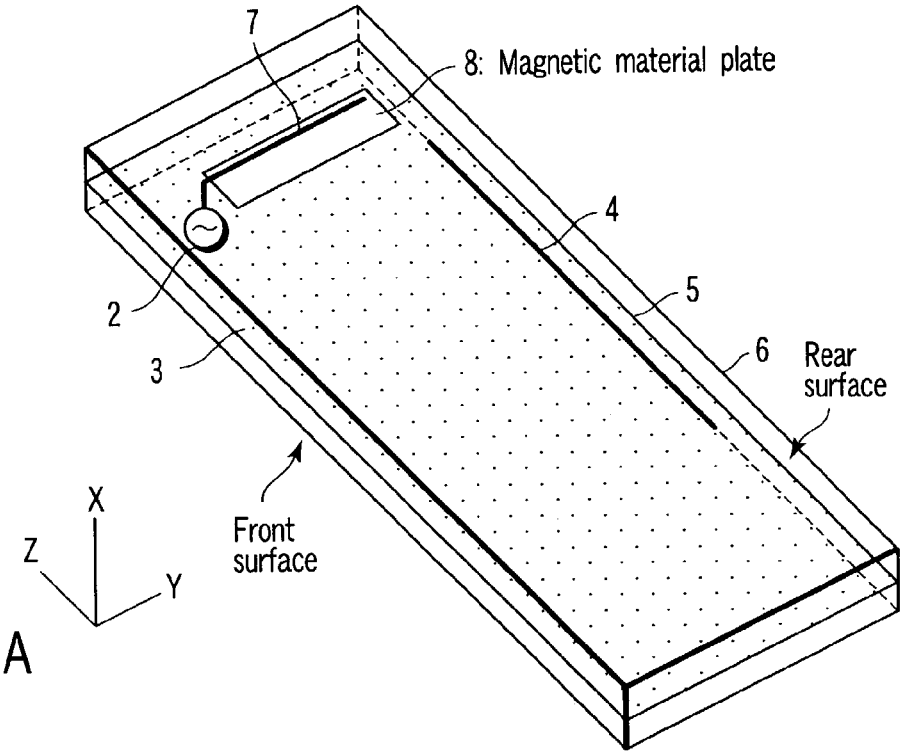
FIG. 7A is a perspective view of the mobile communication terminal with the second antenna element pulled in the cabinet according to the third embodiment.
Figure 7B:
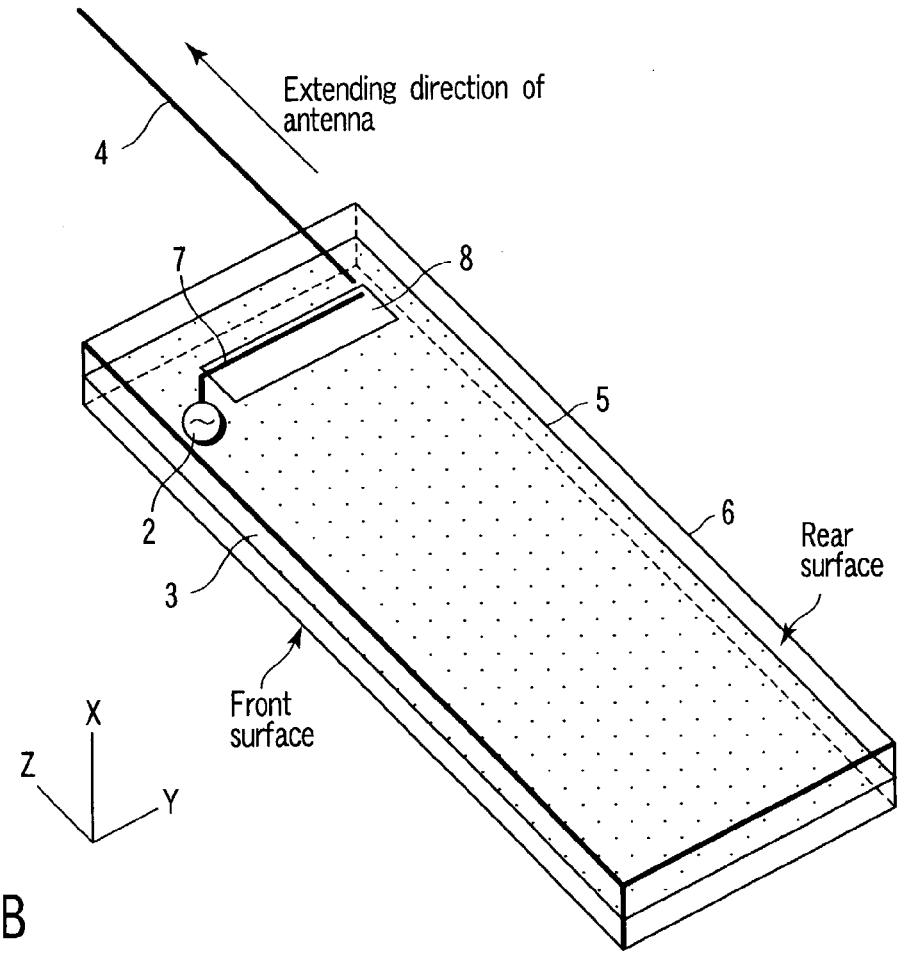
FIG. 7B is a perspective view of the mobile communication terminal with the second antenna element extended from the cabinet according to the third embodiment.

FIG. 7A is a perspective view of the mobile communication terminal with the second antenna element pulled in the cabinet according to the third embodiment. FIG. 7B is a perspective view of the mobile communication terminal with the second antenna element extended from the cabinet according to the third embodiment.

Figure 8:
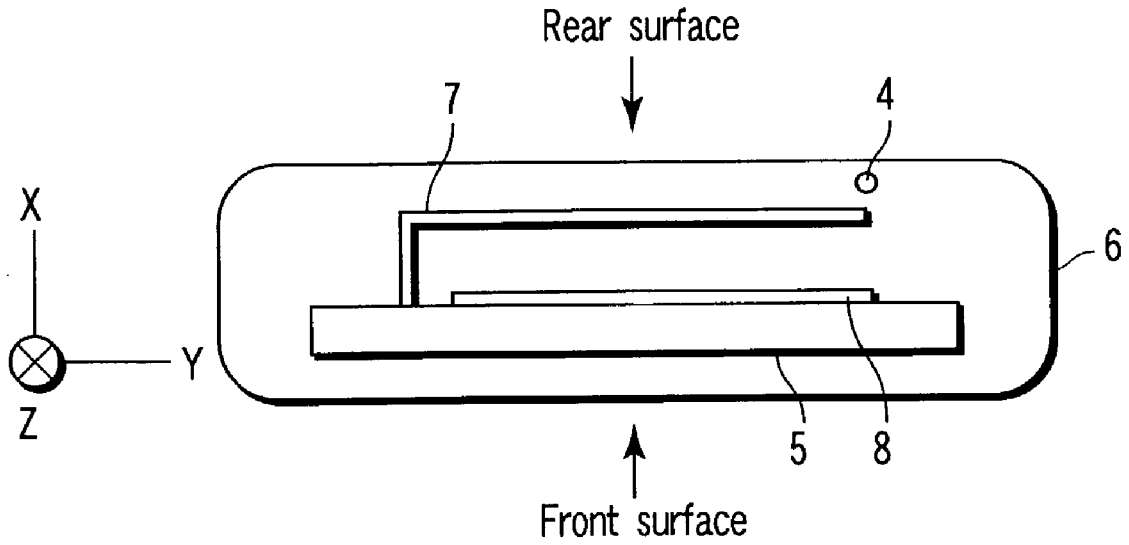
FIG. 8 is a side view of mobile communication terminal shown in FIG. 7A and FIG. 7B as viewed in the negative Z-direction, showing the inside thereof.

FIG. 8 is a side view of mobile communication terminal shown in FIG. 7A and FIG. 7B as viewed in the negative Z-direction, showing the inside thereof.

The mobile communication terminal of this embodiment is similar to the mobile communication terminal of the second embodiment except that the terminal of this embodiment is additionally provided with a flat plate (magnetic material plate 8) that is made of a magnetic material and arranged on the circuit substrate 5 to face the L-shaped antenna 7.

Both the first antenna element 1 of the first embodiment and the first antenna element 7 of the second embodiment induce an unbalanced current to the GND conductor layer 3 of the oppositely disposed circuit substrate. Then, an electric current is induced into the conductor layer of the circuit substrate and also to the terminal cabinet 6 (particularly to the rear surface of the cabinet) due to the unbalanced current.

By mounting a magnetic material plate 8 in this embodiment so as to receive the GND conductor layer 3 of the circuit substrate 5 that faces the first antenna element 7, the intensity of the magnetic field generated on the surface of the GND conductor layer by the unbalanced current is reduced.

As a result, it is possible to suppress the generation of an electric current in the circuit substrate and on the terminal cabinet 6 that is induced by the magnetic field generated from the GND conductor layer. Additionally, the unbalanced current that flows to the GND conductor layer is also suppressed. The unbalanced current is transformed into thermal energy due to the nature of a magnetic material of transforming a high frequency magnetic field into heat and attenuating the high frequency magnetic field. Therefore, with the provision of a magnetic material plate 8, fluctuations of the current distribution of the antenna itself are extremely reduced.

Thus, it is possible to suppress the unbalanced current, the electric current in the circuit substrate 5 and the electric current on the terminal cabinet 6. As a result, the antenna characteristics are prevented from being disturbed. Therefore, the mobile communication terminal is prevented from generating null radiation in the horizontal direction, stabilized in terms of antenna directivity and made to indicate an improved horizontal antenna gain.

The magnetic material plate 8 is typically formed by mixing a dielectric material such as rubber and ferrite, and forming a sheet of the mixture. The electric natures of the magnetic material plate 8 can be defined appropriately by regulating, if necessary, the real part and the imaginary part of the complex magnetic permeability of the magnetic material plate 8.

Since the magnetic material is mounted into the antenna space of the embodiment that is provided in advance, it does not require any additionally space, which may be needed for conventional mobile communication terminals if such a plate is to be mounted in them.

Otherwise, the mobile communication terminal of this embodiment provides advantages similar to those of the second embodiment.

As pointed out above, the mobile communication terminal of the above described third embodiment can effectively suppress undesired electric currents without increasing the space and the surface area for mounting the components if a high radio frequency is used to make the antenna design a difficult one. In other words, due to the reduced cabinet currents, the terminal of this embodiment facilitates the antenna design and reduces the influence of the hand holding the mobile communication terminal or that of the user's head located close to the mobile communication terminal so that it can maintain excellent antenna characteristics.

Fourth Embodiment

Figure 9A:
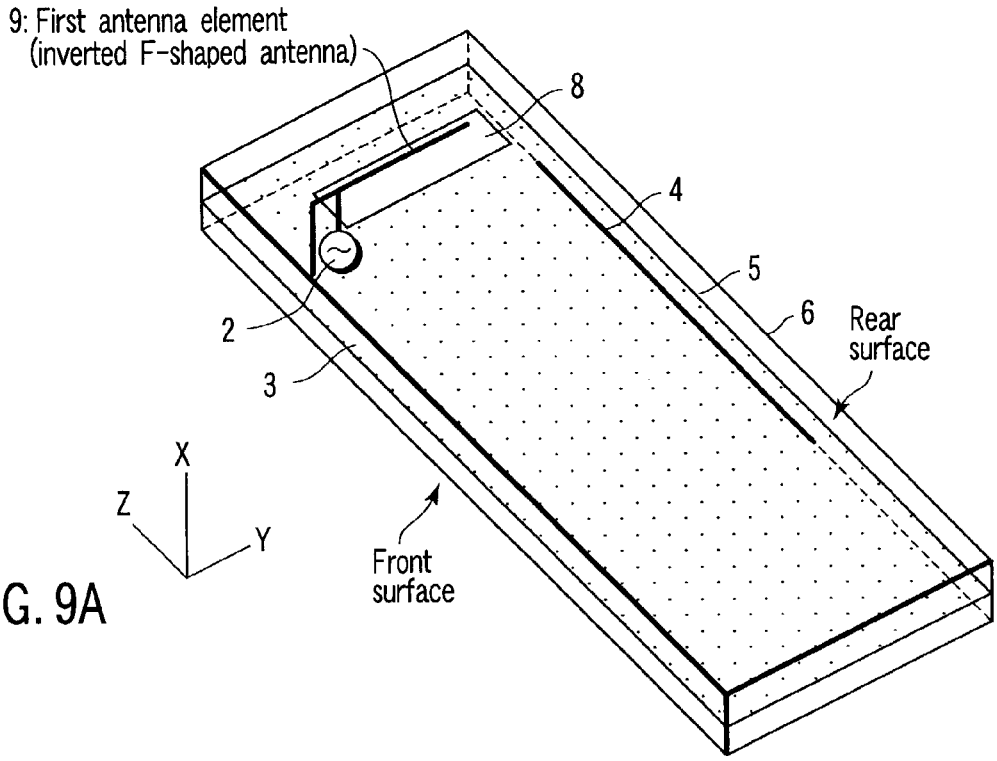
FIG. 9A is a perspective view of the mobile communication terminal with the second antenna element pulled in the cabinet according to the fourth embodiment.
Figure 9B:
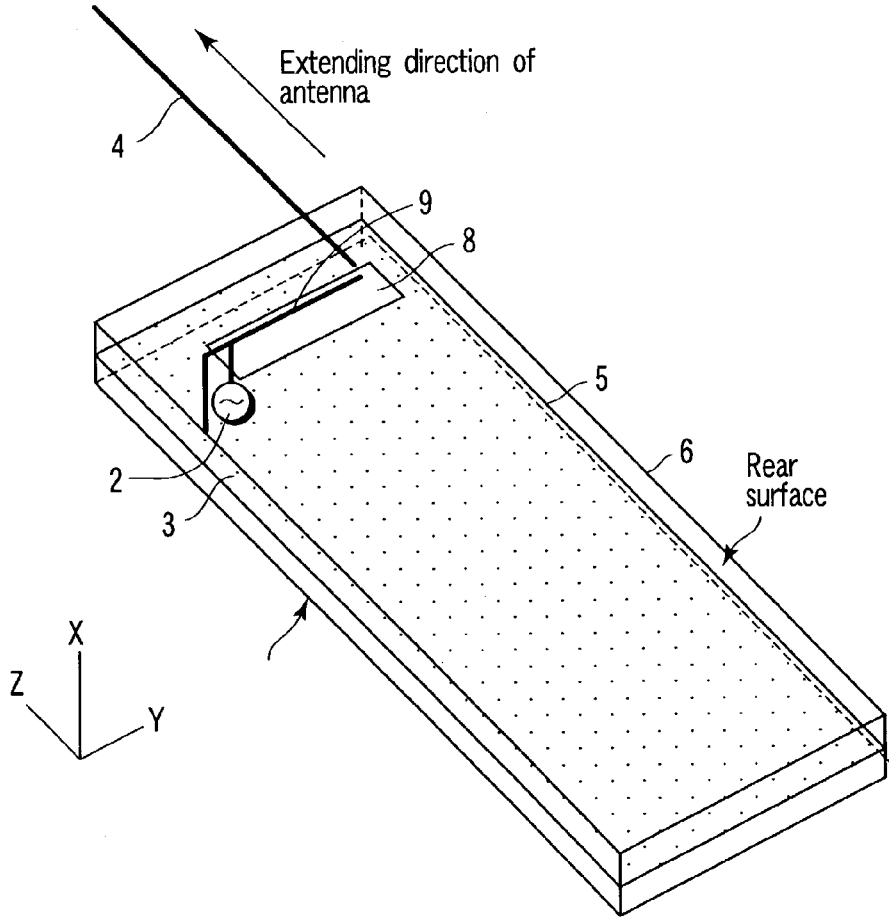
FIG. 9B is a perspective view of the mobile communication terminal with the second antenna element extended from the cabinet according to the fourth embodiment.

FIG. 9A is a perspective view of the mobile communication terminal with the second antenna element pulled in the cabinet according to the fourth embodiment. FIG. 9B is a perspective view of the mobile communication terminal with the second antenna element extended from the cabinet according to the fourth embodiment.

Figure 10:
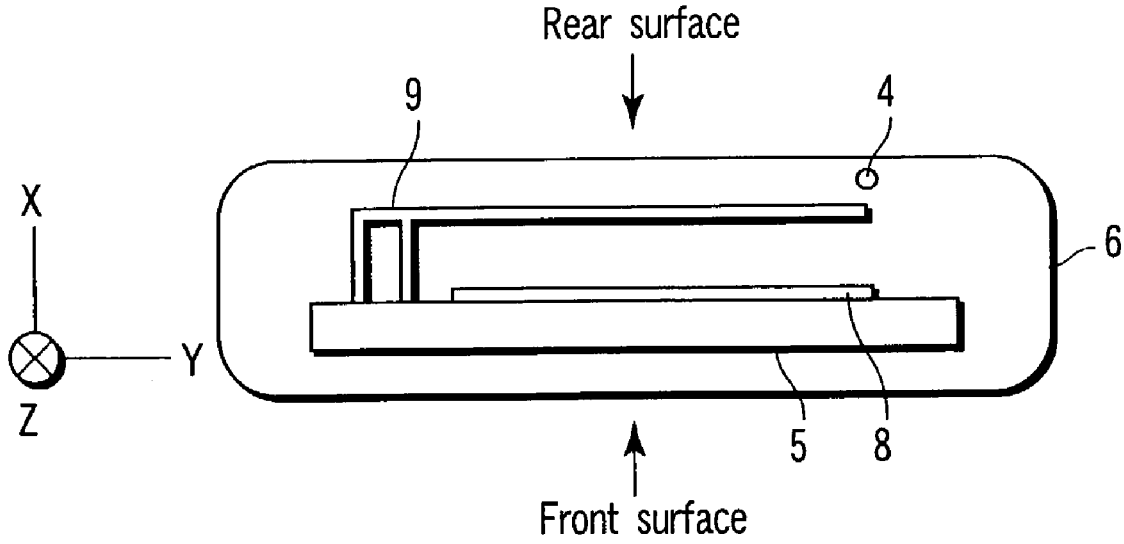
FIG. 10 is a side view of mobile communication terminal shown in FIG. 9A and FIG. 9B as viewed in the negative Z-direction, showing the inside thereof.

FIG. 10 is a side view of mobile communication terminal shown in FIGS. 9A and 9B as viewed in the negative Z-direction, showing the inside thereof.

The mobile communication terminal of this embodiment differs from the mobile communication terminal of the third embodiment in that the L-shaped antenna 7 of the third embodiment is replaced by an inverted F-shaped antenna 9 in this embodiment. Otherwise, the mobile communication terminal of this embodiment is similar to the mobile communication terminal of the third embodiment.

The inverted F-shaped antenna 9 is formed by arranging a conductor for connecting the GND conductor layer 3 and the antenna at a position close to the feeding point of the antenna. The inverted F-shaped antenna 9 provides an advantage that it can be easily made to match the 50 Ω feeder that is normally used in the terminal if compared with the L-shaped antenna 7 of the second or third embodiment. Since the radiation pattern of the inverted F-shaped antenna 9 is not particularly different from that of the L-shaped antenna 7, the mobile communication terminal of this embodiment provides the above described advantage of improving the antenna gain when the user uses the terminal in service for communication.

Otherwise, the mobile communication terminal of this embodiment provides advantages similar to those of the third embodiment.

As pointed out above, the mobile communication terminal of this embodiment allows the antenna to be easily made to match the feeder it can maintain excellent antenna characteristics.

Fifth Embodiment

Figure 11A:
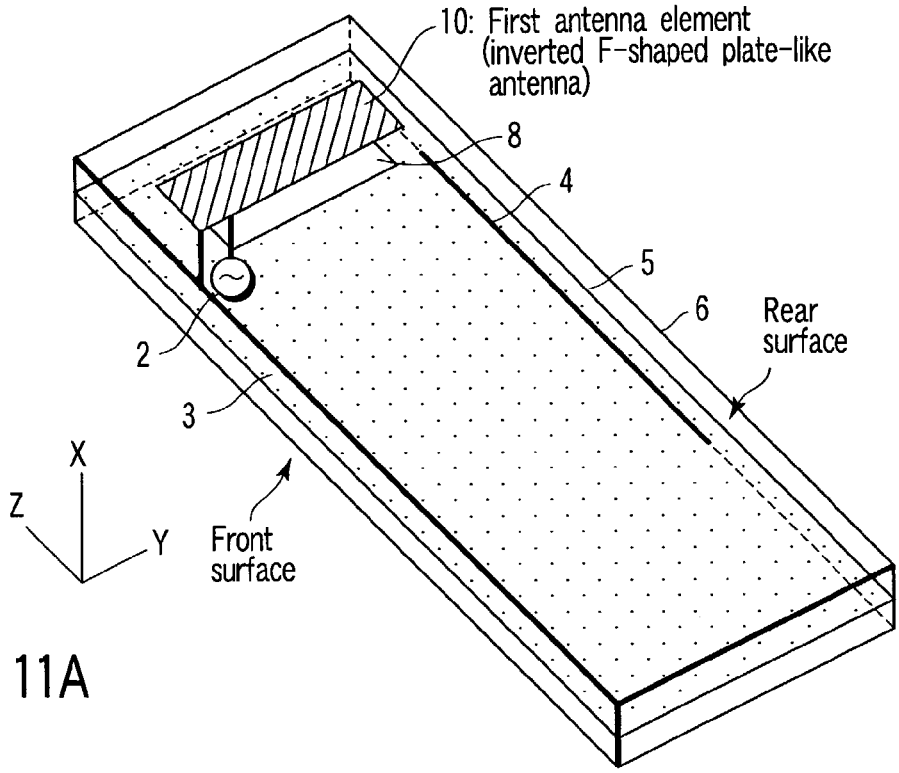
FIG. 11A is a perspective view of the mobile communication terminal with the second antenna element pulled in the cabinet according to the fifth embodiment.
Figure 11B:
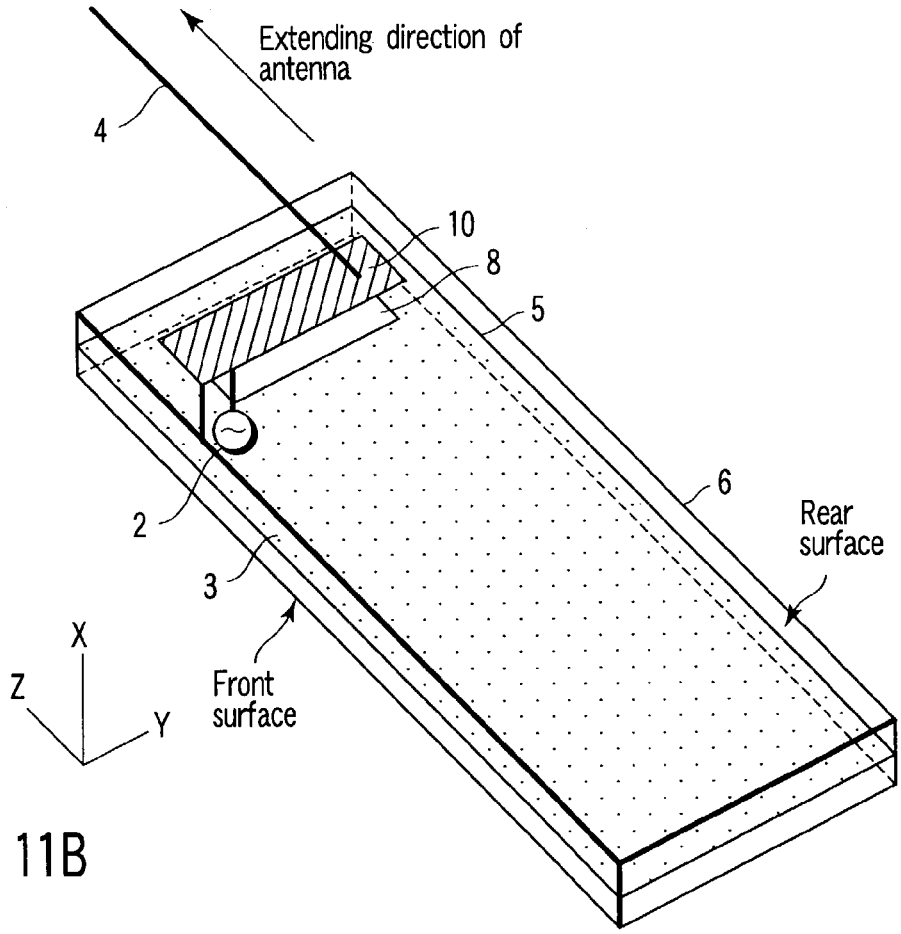
FIG. 11B is a perspective view of the mobile communication terminal with the second antenna element extended from the cabinet according to the fifth embodiment.

FIG. 11A is a perspective view of the mobile communication terminal with the second antenna element pulled in the cabinet according to the fifth embodiment. FIG. 11B is a perspective view of the mobile communication terminal with the second antenna element extended from the cabinet according to the fifth embodiment. FIG. 12 is a side view of mobile communication terminal shown in FIG. 11A and FIG. 11B as viewed in the negative Z-direction, showing the inside thereof.

The mobile communication terminal of this embodiment differs from the mobile communication terminal of the fourth embodiment in that the inverted F-shaped antenna 9 of the fourth embodiment is replaced by an inverted F-shaped plate-like antenna 10 in this embodiment. Otherwise, the mobile communication terminal of this embodiment is similar to the mobile communication terminal of the fourth embodiment. The inverted F-shaped plate-like antenna 10 is formed by replacing the long linear conductor disposed oppositely to the circuit substrate 5 of the inverted F-shaped antenna 9 with a plate. The inverted F-shaped plate-like antenna 10 can be electromagnetically coupled with the second antenna element 4 easily when the second antenna element 4 is extended. It is possible to optimize the electromagnetic coupling by adjusting the surface area of the plate part of the antenna 10.

Otherwise, the mobile communication terminal of this embodiment provides advantages similar to those of the fourth embodiment.

Therefore, the mobile communication terminal of this embodiment can easily realize the electromagnetic coupling of the first antenna element and the second antenna element.

FIG. 13 is a side view of the mobile communication terminal as viewed in the negative Z-direction, showing the inside thereof according to the modified fifth embodiment.

The mobile communication terminal of the modified embodiment as shown in FIG. 13 differs from the mobile communication terminal of the fifth embodiment in terms of the relative positional relationship of the first antenna element 10 and the second antenna element 4. In the fifth embodiment, the second antenna element 4 is located between the inverted F-shaped plate-like antenna 10 and the rear surface of the terminal cabinet 6 when the second antenna element 4 is extended. On the other hand, in the embodiment of FIG. 13, the second antenna element 4 is located between the inverted F-shaped plate-like antenna 10 and the magnetic material plate 8 when the second antenna element 4 is extended.

FIG. 14A is a circuit diagram corresponding to FIG. 12. FIG. 14B is a circuit diagram corresponding to FIG. 13.

As shown in the circuit diagrams of FIGS. 14A and 14B, the inverted F-shaped plate-like antenna 10 and the magnetic material plate 8 disposed oppositely to the antenna 10 operate like a capacitor. Therefore, in the region sandwiched by the inverted F-shaped plate-like antenna 10 and the magnetic material plate 8, the intensity of an electromagnetic field is larger if compared with all the remaining region of the terminal.

Thus, the electromagnetic coupling of the inverted F-shaped plate-like antenna 10 and the second antenna element 4 is stronger in the arrangement of FIG. 14B than in the arrangement of FIG. 14A. Therefore, it is possible to define the strength of the electromagnetic coupling by using this phenomenon so that consequently the band characteristics of the antenna can be adjusted with ease.

An L-shaped antenna, an inverted F-shaped antenna and an inverted F-shaped plate-like antenna are described above as typical examples of the first antenna element in the description of the embodiments. However, the present invention is by no means limited to them and the first antenna element may be realized in the form of a helical antenna, a dielectric-coated antenna, a top load type (top load vertical type) antenna or some other antenna. Additionally, compact antennas realized by using a material that has a high permittivity are marketed in recent years and such a compact antenna may be used for the first antenna element.

The shape, the dimensions and the position of the first antenna element, those of the second antenna element, the configuration of the circuit substrate and the composition of the magnetic material plate may be modified appropriately and selectively in various different ways without departing from the scope of the present invention.

As described above, a mobile communication terminal according to the embodiments of the invention, the first antenna element is active when the second antenna element is pulled in. Since the first antenna element having the above described configuration is a directed in a direction opposite to the head of the user who is on the phone, it is possible to improve the antenna gain when the mobile communication terminal is in service for communication.

When the second antenna element is extended, it is located remotely from the head of the user and is active as main radiator so that it is possible to maintain a high antenna gain when mobile communication terminal is in service. Then, again the first antenna element is directed in a direction opposite to the head of the user and hence it is possible to improve the antenna gain when the mobile communication terminal is in service.

Additionally, the first antenna element and the second antenna element are electromagnetically coupled when the second antenna element is extended so that it is possible to make the antennas active excellently for a broad bandwidth.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A mobile communication terminal comprising:

a terminal cabinet;

a circuit substrate contained in the terminal cabinet;

an internal antenna element arranged between the circuit substrate and a rear surface of the terminal cabinet; and a magnetic material member arranged on the circuit substrate facing the antenna element, the member being physically separated from the antenna element.

2. The mobile communication terminal according to claim 1, wherein the antenna element and the magnetic material member are flat plate-shaped and arranged approximately parallel to each other.

3. A mobile communication terminal, comprising:

a terminal cabinet;

a circuit substrate including a grounding layer and being contained in the terminal cabinet;

an internal antenna element arranged between the circuit substrate and a rear surface of the terminal cabinet; and a magnetic material member arranged between the antenna element and the grounding layer, the member being physically separated from the antenna element.

4. The mobile communication terminal according to claim 3, wherein the antenna element and the member are flat plate-shaped and arranged approximately parallel to each other.

5. The mobile communication terminal according to claim 3, wherein the internal antenna element has a length of about $\lambda/4$, where $\lambda$ represents the wavelength of a radio carrier wave used by the internal antenna for communication.

6. The mobile communication terminal according to claim 3, wherein the magnetic material comprise rubber and ferrite.

* * * * *